US008342911B2

(12) United States Patent
Morita et al.

(10) Patent No.: US 8,342,911 B2
(45) Date of Patent: Jan. 1, 2013

(54) TRUING APPARATUS OF GRINDING WHEEL

(75) Inventors: Hiroshi Morita, Osaka (JP); Tomoyuki Kasuga, Osaka (JP); Takafumi Furutate, Osaka (JP); Akira Makiuchi, Osaka (JP)

(73) Assignee: JTEKT Corporation, Osaka-shi (JP)

( * ) Notice: Subject to any disclaimer, the term of this patent is extended or adjusted under 35 U.S.C. 154(b) by 683 days.

(21) Appl. No.: 12/158,465

(22) PCT Filed: Dec. 20, 2006

(86) PCT No.: PCT/JP2006/325414
§ 371 (c)(1),
(2), (4) Date: Jul. 30, 2009

(87) PCT Pub. No.: WO2007/072879
PCT Pub. Date: Jun. 28, 2007

(65) Prior Publication Data

US 2009/0305618 A1 Dec. 10, 2009

(30) Foreign Application Priority Data

Dec. 22, 2005 (JP) ..... 2005-370928

(51) Int. Cl.
*B24B 21/18* (2006.01)

(52) U.S. Cl. ..... 451/72; 451/246; 451/443; 125/11.01; 125/11.03

(58) Field of Classification Search ..... 451/56, 451/72, 78, 242, 246, 443; 125/11.01, 11.03
See application file for complete search history.

(56) References Cited

U.S. PATENT DOCUMENTS 3,552,375 A * 1/1971 Carr et al. ..... 125/11.03
(Continued)

FOREIGN PATENT DOCUMENTS

EP 327719 A1 * 8/1989
(Continued)

OTHER PUBLICATIONS

U.S. Appl. No. 12/159,534, filed Jun. 27, 2008, Kasuga, et al.

*Primary Examiner* — Eileen P. Morgan
(74) *Attorney, Agent, or Firm* — Oblon, Spivak, McClelland, Maier & Neustadt, L.L.P.

(57) ABSTRACT

A wheel truing apparatus adapted for use in a cylindrical grinding machine wherein a work head with a work spindle for support of a workpiece and a wheel head with a grinding wheel for grinding the workpiece are mounted on a bed for relative movement in a Z-axis direction parallel with the rotation axis of the work spindle and in an X-axis direction crossing the Z-axis direction, characterized in that the wheel truing apparatus comprises a rotary drive portion mounted on the work head or a member united therewith, and a wheel truing tool supported on the rotary drive portion for rotation therewith, the wheel truing tool being provided at its outer periphery with a truing portion for truing a grinding surface of the wheel brought into contact therewith, wherein the rotary drive portion is placed in a position adjacent to said work head in a tooling area defined by a stroke of the relative movements of said wheel head and said work head in the Z-axis direction and apart from said work spindle radially outward and is arranged in such a manner that the rotation axis line of said truing tool is oriented toward the rotation axis line of said grinding wheel in a condition where said truing portion is retained in contact with the grinding surface of said wheel, whereby the truing portion of said tool is brought into contact with the grinding surface of said wheel by relative movement of said wheel head to said work head for truing the grinding surface.

5 Claims, 3 Drawing Sheets

U.S. PATENT DOCUMENTS 3,678,915 A * 7/1972 Kikuchi ..... 125/11.03
3,683,885 A * 8/1972 Kikuchi ..... 125/11.03
3,747,584 A * 7/1973 Kikuchi ..... 125/11.03
4,073,281 A * 2/1978 Asaeda et al. ..... 125/11.03
4,122,635 A * 10/1978 Asano et al. ..... 451/5
4,551,950 A * 11/1985 Unno et al. ..... 451/5
4,557,078 A * 12/1985 Brill ..... 451/21
4,640,059 A * 2/1987 Komossa et al. ..... 451/72
4,862,868 A * 9/1989 Dodd et al. ..... 125/11.03
4,897,964 A * 2/1990 Vetter ..... 451/72
4,915,089 A * 4/1990 Ruark et al. ..... 125/11.03
4,984,390 A * 1/1991 Kobayashi ..... 451/443
5,235,959 A * 8/1993 Frank et al. ..... 125/11.01
5,363,598 A 11/1994 Imai et al.
5,551,908 A * 9/1996 Harada ..... 451/72
5,595,528 A * 1/1997 Becker ..... 451/72
5,711,696 A * 1/1998 Maeda et al. ..... 451/5
6,328,636 B1 * 12/2001 Yoshimi et al. ..... 451/56

FOREIGN PATENT DOCUMENTS

EP 551904 A1 * 7/1993
GB 2174323 A * 11/1986
JP 1-502500 8/1989
JP 02009577 A * 1/1990
JP 5-29665 4/1993
JP 8-90411 4/1996
JP 2749154 2/1998
JP 2000-107982 4/2000
JP 2002-283235 10/2002
JP 2003-340714 12/2003
JP 2005-262333 9/2005

* cited by examiner 10
11
12
13
13a
14
15
15a
16
16a
16b
17
17a
17b
17c
17d
17e
18
19
20
20A
21
21a
22
01
02
R
W
Wa
X
Z
2

17
17b
17a
16b
X
20B
12
W
13
01
02
21b
21a
25
24
23
21
22A
17e
17c
11

17
17b
17a
16b
X
12
W
13
23
20C
01
02
24A
21b
21A
17e
24
22
17c
03
26
26a
11

TRUING APPARATUS OF GRINDING WHEEL

FIELD OF THE INVENTION

The present invention relates to a truing apparatus of a grinding wheel installed in a cylindrical grinding machine for truing the grinding surface of the wheel.

DISCUSSION OF THE PRIOR ART

While a grinding machine is being operated to grind a workpiece, the grinding wheel of the machine is deformed at its grinding surface or grinding particles of the wheel are rounded. This causes deterioration of the machining precision or cutting performance of the wheel. It is therefore needed to restore the grinding surface of the wheel. The restoration of the grinding surface is carried out by truing the grinding surface to an accurate shape or dressing the grinding surface for restoration of the cutting performance.

In a cylindrical grinding machine having a work spindle supported on a work head for rotation with a workpiece carried thereon and a grinding wheel supported on a wheel head for grinding the workpiece, the work head is mounted on a bed of the machine for movement in a Z-axis direction parallel with the axis of the work spindle, while the wheel head is mounted on the bed for movement in the X-axis direction perpendicular to the Z-axis direction. In a tooling area (shown by a reference character R in FIG. 1) between the work head and a tailstock, there are provided a workpiece, a tentative support for temporarily supporting the workpiece to be transferred into and out of the tooling area, a workpiece-rest for receiving a grinding reaction force applied to the workpiece, a measurement device for measuring a ground portion of the workpiece during grinding operation, and other accessory devices. Additionally, transfer devices of the grinding wheel and the workpiece are brought into the tooling area. It is, therefore, difficult to provide a truing or dressing apparatus in the tooling area in such a manner as to avoid interference with the transfer devices.

Disclosed in Japanese Patent Laid-open Publication No. 2002-283235 is a truing apparatus of the type which includes a diamond truer of the disc type placed beside the wheel head adjacent to the work head to be rotated about an axis-line in parallel with the X-axis direction. In the truing device, an end surface of the grinding wheel is trued by the outer periphery of the diamond truer when the wheel head is forwarded in the X-axis direction in a condition where the table of the work head has been moved in the Z-axis direction and positioned in place. When forwarded in the X-axis direction in such a truing operation, the wheel head is stopped for a short time to form a shallow groove in the end surface of the grinding wheel.

As the truing device is located adjacent to the work head, the amount of relative movement between the work head and the wheel head in the Z-axis direction becomes large when the grinding operation is changed to the truing operation of the workpiece. For this reason, the positioning precision between the work head and the wheel head is deteriorated. As the splash extent of coolant necessary for the grinding and truing operations becomes wide, the maintenance of the apparatus is deteriorated, and the sealing portion for preventing leakage of the coolant becomes large in size and complicated in structure, resulting in increase of the manufacturing cost.

Disclosed also in Japanese Patent Laid Open-Publication No. 2749154 is a rotary dressing apparatus installed adjacent to a work head. The rotary dressing apparatus comprises a support-drive device composed of a surface plate and a chuck device, a cylindrical rotary dressing body concentrically fixed in place between the support-drive device and an end surface of a work spindle and a conical dresser formed on the outer periphery of the rotary dressing body. The distal end of the dresser is protruded radially outward from an outer peripheral portion of the chuck device. When the rotary dressing device is used to dress internal and external grinding wheels, the work spindle is driven to rotate the dresser of the rotary dressing body and is traversed in condition where the internal and external grinding wheels are respectively pressed to the dresser. As the dressing apparatus of grinding wheel is installed in a position adjacent to the work head as described above, the amount of relative movement of the work head and the wheel head in the Z axis direction for transfer from the grinding position to the truing position can be decreased to enhance the positioning precision of the work head and the wheel head. This is useful to make the rotary dressing apparatus small in size as a whole. As the splash extent of coolant becomes narrow, the maintenance property of the apparatus is enhanced, and the sealing portion of coolant can be simplified in size and structure.

However, the relative rotation speed of the dresser and the grinding wheel is increased due to the facts that the rotation speed of the grinding wheel is 8~9000 r.p.m. while the rotation speed of the work spindle with the dresser is 4000 r.p.m. and that the circumferential speed of the outer periphery of the dresser is much smaller than that of the grinding wheel. For this reason, acute corners once formed by coarse crush in the grinding surface are ground and flattened, resulting in deterioration of cutting performance of the grinding wheel. To overcome such a drawback, it is needed to decrease the rotation speed of the grinding wheel thereby to decrease the relative rotation speed of the outer periphery surface of the dresser and the grinding surface of the wheel dressed by the dresser. If the rotation speed of the grinding wheel was decreased, the time required for truing or dressing the grinding wheel would be increased, resulting in a decrease of productivity of the grinding machine.

SUMMARY OF THE INVENTION

A primary object of the present invention is to provide a wheel truing apparatus capable of overcoming the problems discussed above.

According to the present invention, the primary object is accomplished by providing a wheel truing apparatus adapted for use in a cylindrical grinding machine wherein a work head with a work spindle for support of a workpiece and a wheel head with a grinding wheel for grinding the workpiece are mounted on a bed for relative movement in a Z-axis direction parallel with the rotation axis of the work spindle and in an X-axis direction across the Z-axis direction, wherein the wheel truing apparatus comprises a rotary drive portion mounted on the work head or a member united therewith, and a wheel truing tool supported on the rotary drive portion for rotation therewith, the wheel truing tool being provided at its outer periphery with a truing portion for truing a grinding surface of the wheel brought into contact therewith, wherein the rotary drive portion is located adjacent to the work head in a tooling area defined by a stroke of the relative movements of the wheel head and the work head in the Z-axis direction and apart from the work spindle radially outward and is arranged in such a manner that the rotation axis line of the truing tool is oriented toward the rotation axis line of the grinding wheel in a condition where the truing portion is retained in contact with the grinding surface of the wheel, whereby the truing portion of the tool is brought into contact with the grinding surface of the wheel by relative movement of the wheel head to the work head for truing the grinding surface.

As the wheel truing apparatus is arranged adjacent to the work spindle in such a manner as to avoid contact with the workpiece and apart from the work spindle radially outward, the truing apparatus is installed without any interference with a tentative support, a workpiece rest, a measuring device even in the tooling area. With such arrangement of the truing apparatus, the amount of relative movement of the work head and the wheel head in the Z-axis direction for changing the grinding operation to the truing operation can be decreased to enhance the positioning precision of the work head and the wheel head. This is also useful to make the grinding machine small in size as a whole, to make the splash extent of coolant narrow, and to make the sealing portion of coolant small in size and simple in construction. As the rotation axis line of the truing portion of the tool is oriented toward the rotation axis line of the grinding wheel in a condition where the truing portion is placed in contact with the grinding surface of the wheel, a crossing angle between the circumferential speed of the truing portion and the circumferential speed of the grinding surface of the wheel becomes zero or a slight value in an area where the truing portion is brought into contact with the grinding surface of the wheel. This is useful to prevent deterioration of the cutting performance of the grinding wheel after truing.

In a case that the workpiece is supported at its opposite ends by means of the work spindle of the work head and a spindle of a tailstock mounted on the bed of the grinding machine, even a workpiece of long length can be ground in a stable condition.

In a practical embodiment of the present invention, the rotary drive portion of the truing apparatus may be substituted for a rotary drive portion placed adjacent to the tailstock in the tooling area in such a manner as to avoid contact with the workpiece and apart from the tailstock spindle radially outward. Alternatively, in addition to the rotary drive portion placed adjacent to the work head, a rotary drive portion for the truing tool may be placed adjacent to the tailstock in the tooling area and apart from the tailstock radially outward. The rotary drive portion of the truing apparatus may be placed under the work spindle or the tailstock spindle or above the work spindle or the tailstock spindle. In such a case, an interference with a transfer device provided above or under the work spindle and the tailstock can be avoided in the tooling area.

In the truing apparatus, it is desirable that the truing portion of the tool comprises a first truing portion in the form of a thin disc extending radially outward from the outer periphery of a disc base driven by the rotary drive portion and a second cylindrical truing portion protruding in axial line direction. In such a case, different grinding surfaces of the wheel can be efficiently trued by the first and second truing portions.

In a case that the grinding wheel is supported on the work head for rotation about a rotation axis line perpendicular to the X-axis direction while the wheel truing tool is supported on the rotary drive portion for rotation about a rotation axis line perpendicular to the rotation axis line of the grinding wheel and that the wheel head is moved in the X-axis direction relatively to the work head, an end surface of the grinding wheel crossing perpendicularly to the rotation axis line can be trued by the outer periphery of a truing portion protruded radially outward from the truing tool.

In a case that the wheel truing apparatus further includes a rotary support member mounted on the work head or a member united therewith for supporting the rotary drive portion in such a manner that the rotary drive portion is rotated about a rotation axis line perpendicular to the rotation axis line of the grinding wheel and is rotated about a rotation axis line parallel with the rotation axis line of the grinding wheel, the rotary drive portion is rotated by the rotary support member to change the direction of the truing tool for truing different grinding surfaces of the wheel.

DESCRIPTION OF THE PREFERRED EMBODIMENTS

Figure 1:
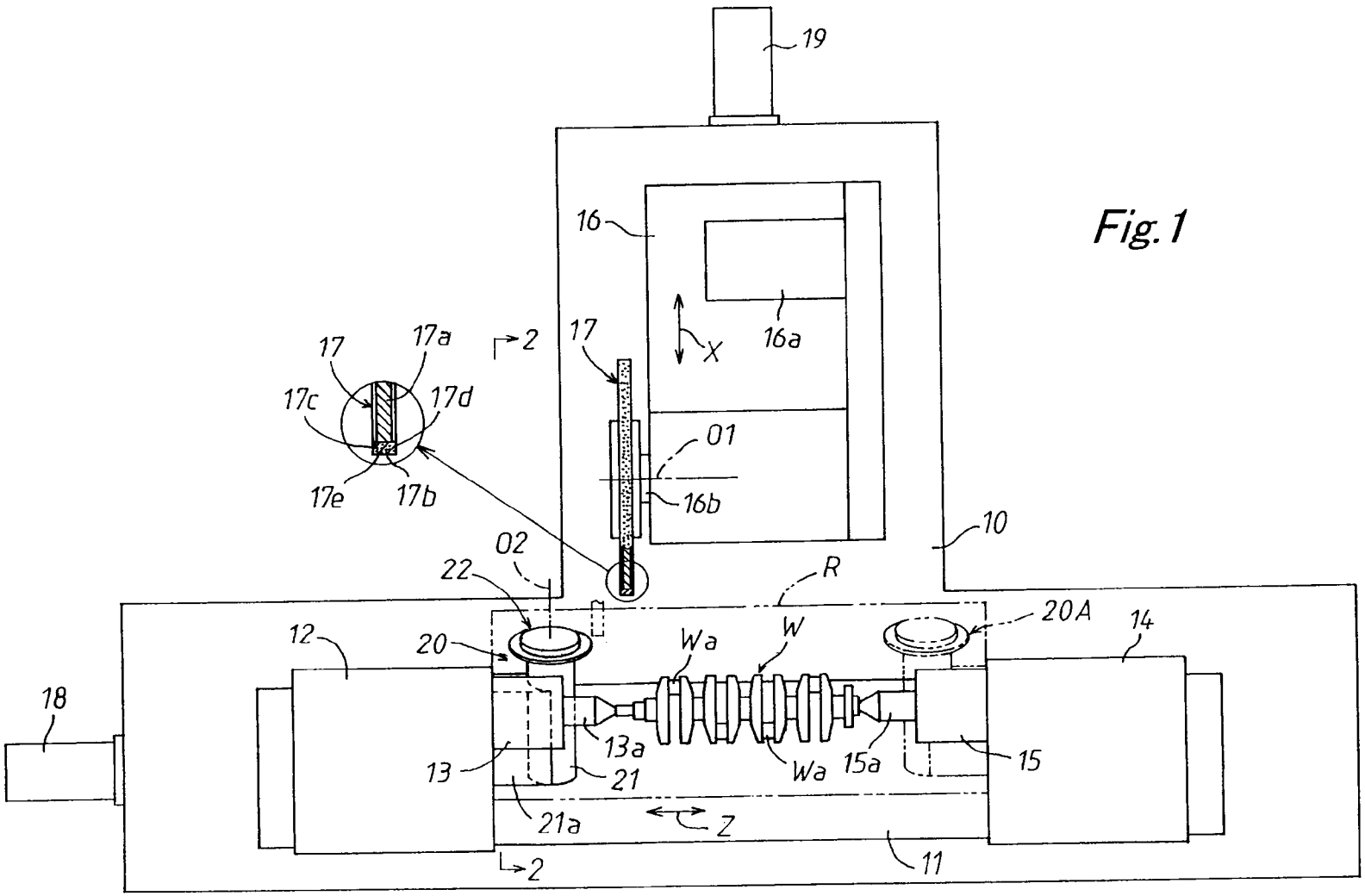
FIG. 1 is a plan view of a first embodiment of a cylindrical grinding machine with a truing apparatus according to the present invention.
Figure 2:
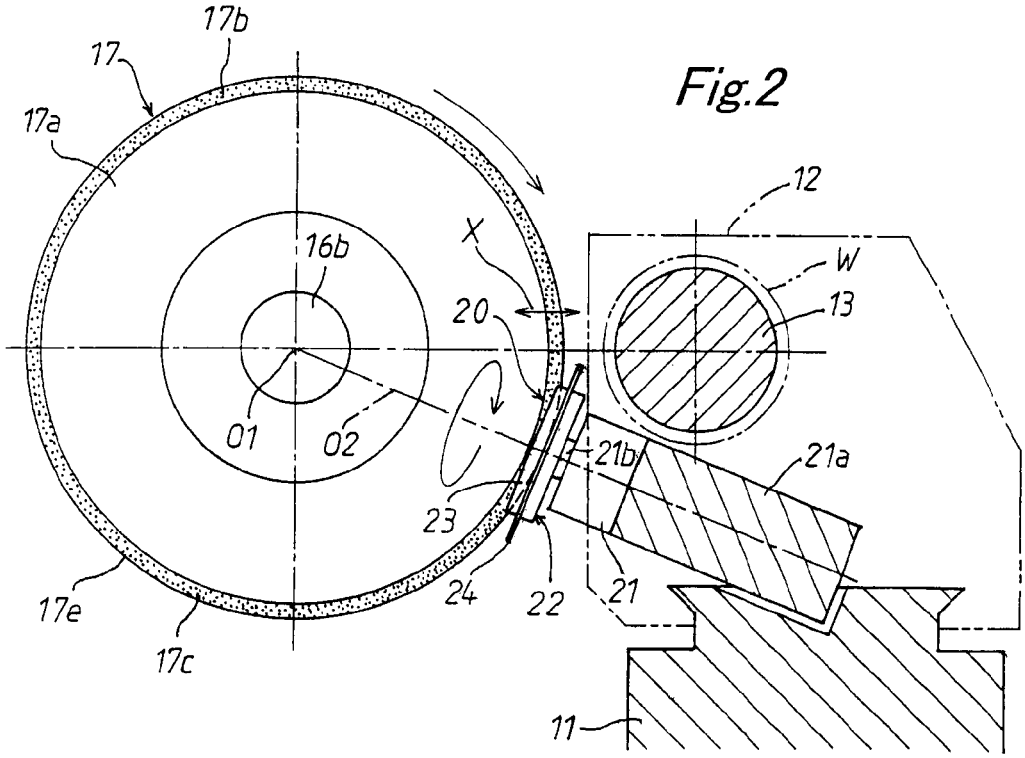
FIG. 2 is an enlarged sectional view taking along line 2-2 in FIG. 1.
Figure 3:
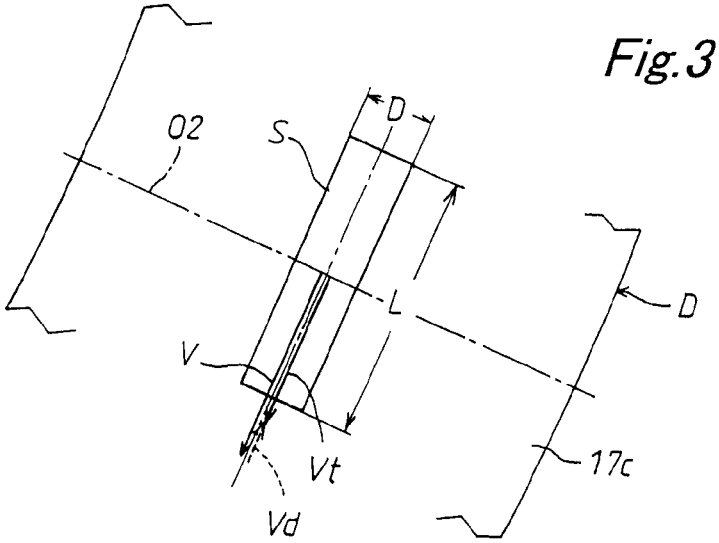
FIG. 3 is a partly enlarged sectional view showing an area where an outer periphery of a truing tool of the truing apparatus is brought into contact with an end surface of a grinding wheel.

Hereinafter, a first embodiment of a wheel truing apparatus in accordance with the present invention will be described with reference to FIGS. 1~3. FIG. 1 illustrates a cylindrical grinding machine with a wheel truing apparatus, and FIG. 2 illustrates an enlarged section taken along line 2-2 in FIG. 1. As shown in FIG. 1, a work table 11 is supported on a bed of the cylindrical grinding machine for horizontal movement in left and right directions (the Z-axis direction) and is reciprocated by a Z-axis motor 18. Mounted on the work table 11 are a work head 12 for support of a work spindle 13 in parallel with the Z-axis direction and a tailstock 14 opposed to the work head 12 in the Z-axis direction for support of a tailstock spindle 15 coaxially with the work spindle 13. A workpiece W (in the form of a crankshaft of an internal combustion engine in the first embodiment shown in FIG. 1) is supported at its opposite ends by means of centers 13*a* and 15*a* fixed to and projected from the work spindle 13 and the tailstock spindle 15*a*. The work spindle 13 is driven by a servomotor (not shown) housed in the work head 12 to rotate the workpiece W therewith through a work carry (not shown).

In a space between an end surface of the work head 12 from which the work spindle 13 is projected and an end surface of the tailstock 14 from which the tailstock spindle 15 is projected, there are provided a tentative support for temporarily supporting the workpiece W transferred inward and outward, a workpiece rest for receiving a grinding reaction force applied to the workpiece, a measurement device for measuring a ground portion of the workpiece W during grinding operation, and accessory devices. The space between the work head 12 and the tailstock 14 is provided as a tooling area permitting entry of the grinding wheel 17 for grinding the workpiece W. In this embodiment, a wheel truing apparatus 20 is provided on the end surface of work head 12 in a position under the work spindle 13.

As shown in FIG. 1, a wheel head 16 is mounted on the bed 10 for horizontal movement in an X-axis direction perpendicular to the Z-axis direction, and a grinding wheel 17 is rotatably supported on the wheel head 16 through a wheel spindle 16*b* having a rotation axis line O1 located perpendicularly to the X-axis direction at the same height as the rotation axis line of the work spindle 13. The grinding wheel 17 is driven by a wheel motor 16*a* through a transfer mechanism of the V-belt type (not shown). The grinding wheel 17 has an annular grinding wheel layer 17*b* composed of CBN abrasive grains bonded to an outer periphery of a metallic disc core 17*a*. The side surfaces 17*c*, 17*d* of the grinding wheel layer 17*b* perpendicular to the rotation axis line O1 and the outer peripheral end surface 17*e* of the grinding wheel layer 17*b* coaxial with the rotation axis line O1 are brought into contact with a portion of the workpiece W such as a crank pin portion of the crank shaft to be ground.

As shown in FIGS. 1 and 2, the wheel truing apparatus 20 comprises a rotary drive portion 21 and a truing tool 22 coaxially supported on the rotary drive portion 21 through a rotary shaft 21*b* to be driven by a built-in motor. The truing tool 22 is composed of a base 23 in the form of a thick disc fixed to the rotary shaft 21*b* of the rotary drive portion 21 for rotation therewith and a truing portion 24 in the form of diamond grains bonded to a thin disc extending radially outward from an intermediate portion of the outer peripheral surface of base 23. The rotary drive portion 21 is apart from the work spindle 13 radially downward in a position adjacent to the work head 12 in the tooling area R and fixed to an end face of work head 12 through a bracket 21*a* in such a manner that a rotation axis line O2 of the truing tool 22 is positioned in a direction perpendicular to the rotation axis line O1 of grinding wheel 17 and is oriented toward the rotation axis line O1 as shown in FIG. 2 in a condition where the truing portion 24 is placed in contact with the side surface 17*c* or 17*d* of grinding wheel 17 as described later. The rotary drive portion 21 may be mounted on the work table 11 united with the work head 12.

Hereinafter, the operation of the first embodiment will be described. For truing the end surface 17*c* of the grinding wheel 17, the grinding wheel 17 and the truing tool are rotated, and the work table 11 is moved by activation of the Z-axis motor 18 in the Z-axis direction. The work table 11 is stopped at a position where the outer periphery of truing portion 24 is cut into the side surface 17*c* of grinding wheel 17 in a slight amount. Subsequently, the wheel head 16 is moved by activation of the X-axis motor 19 in the X-axis direction and forwarded by quick traverse to a position where the grinding wheel layer 17*b* approaches the truing portion 24 of tool 22. Thus, the wheel head 16 is transferred at a truing speed so that the side surface 17*c* of the grinding wheel layer 17*b* is trued by the outer periphery of the truing portion 24. In this instance, the circumferential speed Vt of the outer periphery of truing portion 24 is set slightly less than that of the side surface 17*c* of grinding wheel 17, and the feed amount of the wheel head 16 in the X-axis direction per one rotation of the grinding wheel 17 in truing operation is about a small fraction of the thickness of the truing portion 24. For truing the opposite side surface 17*d* of the grinding wheel 17, the truing tool 22 is rotated in a reverse direction by the rotary drive portion 21, and the outer periphery of the truing portion 24 is cut into the side surface 17*d* of grinding wheel 17 in a slight amount in the same manner as described above.

In the first embodiment, the rotary drive portion 21 of the wheel truing apparatus is arranged in such a manner that the rotation axis line O2 of the truing tool 22 is oriented toward the rotation axis line O1 in a condition where the truing portion 24 is placed in contact with the side surface 17*c* or 17*d* of grinding wheel 17 as described above. Accordingly, in an area S where the outer periphery of the truing portion 24 is brought into contact with the side surface 17*c* of grinding wheel 17, the circumferential speed of the side surface 17*c* of grinding wheel 17 is in a direction along a length L shown in FIG. 3, and an angular difference between the circumferential speed Vt of the outer periphery of truing portion 24 and the circumferential speed V of the side surface 17*c* of grinding wheel 17 becomes substantially zero. Thus, the CBN grains of the side surface 17*c* of grinding wheel 17 are sufficiently crushed by the truing portion 24 without being excessively fined and are not flattened. In comparison with the prior art, deterioration of the cutting performance of the grinding wheel after truing is prevented. As the feed speed of the grinding wheel 17 in the X-axis direction is much smaller than the circumferential speeds V and Vt, the foregoing function may not be influenced.

As in the first embodiment, the workpiece W is supported at its opposite ends by means of the work spindle 13 and the tailstock spindle 15, even a workpiece of long length can be ground in a stable condition. It is, however, noted that the present invention can be applied to grind a workpiece supported at its one end by means of a chuck device attached to the work head.

In the first embodiment, the rotary drive portion 21 of the wheel truing apparatus 20 can be installed without any interference with the transfer device provided above the work spindle 13 and the tailstock spindle 15 in the tooling area since it is placed in a position spaced from the work spindle 13 radially downward as described above. In another practical embodiment, the rotary drive portion 21 may be arranged in a position apart from the work spindle radially upward in such a manner as to avoid an interference with the transfer device.

Although in the first embodiment, the rotary drive portion 21 of the wheel truing apparatus is provided adjacent to the work head 12, the rotary drive portion 21 may be installed in a position adjacent to the tailstock 14 and apart from the tailstock spindle 15 and the workpiece W radially outward as shown by two-dots chain line 22A in FIG. 1. Alternatively, the wheel truing apparatus may be installed adjacent to the work head 12 and the tailstock 14, respectively.

Figure 4:
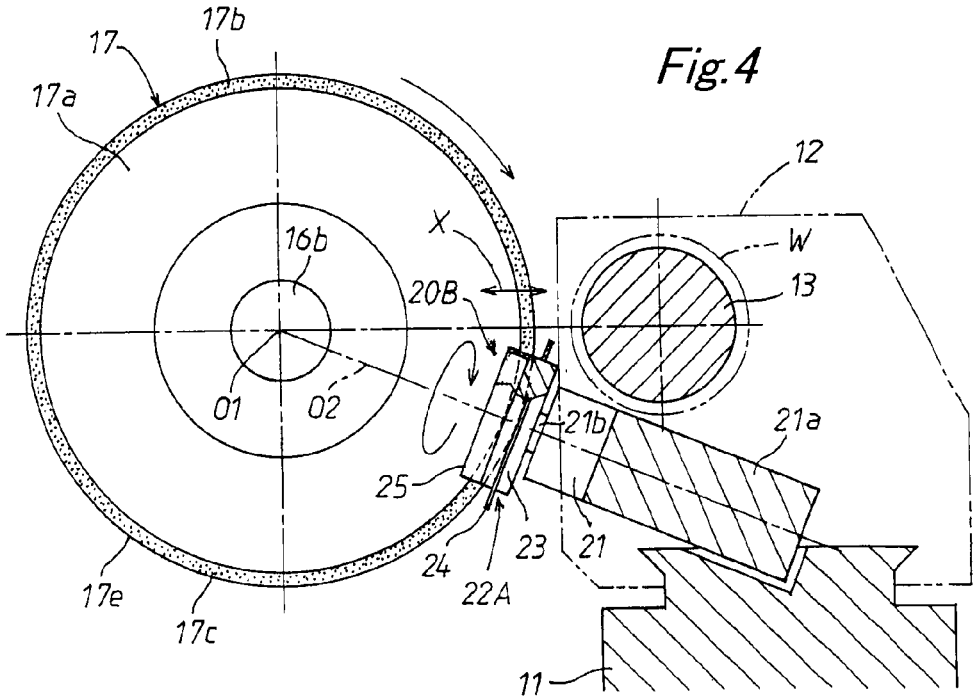
FIG. 4 is an enlarged sectional view of a second embodiment of the present invention, which corresponds with the illustration of FIG. 2.

Illustrated in FIG. 4 is a second embodiment of the present invention wherein only a truing tool 22A supported on and driven by the rotary shaft 21*b* of the rotary drive portion 21 is different from the first embodiment. The other construction of the second embodiment is the same as that of the first embodiment. The truing tool 22A is composed of a base 23 in the form of a disc coaxially fixed to the rotary shaft 21*b* of the rotary drive portion 21 for rotation therewith, a first truing portion 24 in the form of a thin disc protruded radially outward from the outer periphery of the base, and a second truing portion 25 in the form of a thin cylindrical portion protruded from the outer periphery of base 23 toward the wheel spindle 16 in the axis line direction. The base 23 is the same as that in the first embodiment, and the first truing portion 24 is the same as that in the first embodiment. The second truing portion 25 is composed of diamond grains bonded to a thin disc in the same manner as in the first truing portion 24, and the thickness of the second truing portion 25 is substantially the same as that of the first truing portion 24. The rotary drive portion 21 is arranged in such a manner that the rotation axis line O2 of the truing tool 22A is positioned in a direction perpendicular to the rotation axis line O1 of the grinding wheel 17 and is oriented toward the rotation axis line O1 in a condition where the first truing portion 24 is in contact with the side surface 17*c* or 17*d* of grinding wheel 17 for truing the same and where the second truing portion 25 is in contact with the end surface 17*e* of grinding wheel 17. The side surface 17*d* of grinding wheel 17 is trued by reverse rotation of the truing tool 22A in the same manner as in the first embodiment. In the second embodiment, the side surfaces 17*c*, 17*d* and end surface 17*e* of grinding wheel 17 can be efficiently trued by the first and second truing portions 24 and 25 of the single wheel truing apparatus 20B.

Figure 5:
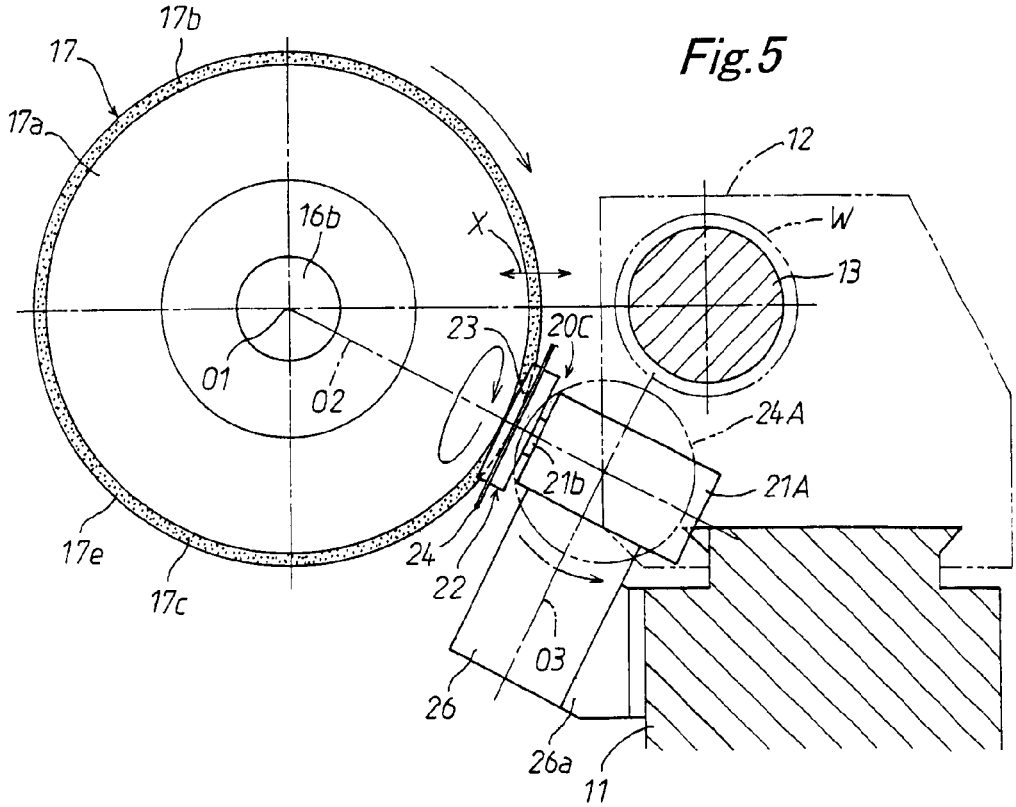
FIG. 5 is an enlarged sectional view of a third embodiment of the present invention, which corresponds with the illustration of FIG. 2.

Illustrated in FIG. 5 is a third embodiment of the present invention, wherein a rotary drive portion 21A of a wheel truing apparatus 20C is mounted on the work table 11 through a rotatable support 26 and a bracket 26*a* for rotation about an axis line O3. The rotary drive portion 21A is rotated about the axis line O3 in a position where the rotation axis line O2 of the rotary drive portion 21A is positioned perpendicularly to the rotation axis line O1 of grinding wheel 17 and in a position where the rotation axis line O2 of the rotary drive portion 21A is positioned in parallel with the rotation axis line O1 of grinding wheel 17. The other construction is the same as that of the first embodiment. When the wheel truing apparatus 20C is retained in a position where the rotation axis line O2 of the rotary drive portion 21A is positioned perpendicularly to the rotation axis line O1 of grinding wheel 17 as shown by solid lines in FIG. 5, the side surface 17*c* of grinding wheel 17 is trued by contact with the truing portion 24. The opposite side surface 17*d* of grinding wheel 17 is trued by reverse rotation of the truing tool 22A as in the embodiments described above. When the truing portion 24 of wheel truing apparatus 20C is placed in a position where the rotation axis line O2 of the rotary drive portion 21A is positioned in parallel with the rotation axis line O1 of grinding wheel 17 as shown by two dotted lines in FIG. 5, the outer peripheral end surface 17*e* of grinding wheel 17 is trued by contact with the truing portion 24. As in the third embodiment, the rotary drive portion 21A is rotated by the rotary support 26 to change the direction of the truing tool 22, the side and end surfaces 17*c*, 17*d* and 17*e* of grinding wheel 17 can be efficiently trued by the truing portion 24.

Although the foregoing embodiments were applied to a grinding machine of the table-traverse type wherein the work head 12 is mounted on the work table 11 movable on the bed 10 in the Z-axis direction while the wheel head 16 is movably mounted on the bed 10 in the X-axis direction, the present invention may be applied to a cylindrical grinding machine of the other type such as a grinding machine of the wheel-traverse type wherein a work head is fixedly mounted on a bed while a wheel head is mounted on the bed for movements in the Z-axis direction and the X-axis direction for machining of a workpiece.

The invention claimed is:

1. A wheel truing apparatus adapted for use in a cylindrical grinding machine wherein a work table provided with a work head with a work spindle and a tail stock for support of a workpiece, and a wheel head with a grinding wheel for grinding the workpiece, are mounted on a bed for respective relative movement in a Z-axis direction parallel with the rotation axis of the work spindle and in an X-axis direction intersecting the Z-axis direction, and a transfer device is provided above the work spindle, wherein the wheel truing apparatus comprises a rotary drive portion mounted on the work head or the work table, and a wheel truing tool supported on the rotary drive portion for rotation therewith, the wheel truing tool being provided at its outer periphery with a truing portion for truing a grinding surface of the grinding wheel brought into contact therewith, wherein the rotary drive portion is placed in a position adjacent to said work head in a tooling area in the Z-direction, the tooling area being defined between said work head and said tail stock in the Z-axis direction, and wherein the rotary drive portion is spaced radially downward from said work spindle to avoid interference with the transfer device provided above the work spindle, and wherein the rotary drive portion is arranged such that the rotation axis line of said truing tool is oriented perpendicular to the rotation axis line of said grinding wheel in a condition where said truing portion is placed in contact with the grinding surface of said grinding wheel, whereby the truing portion of said truing tool may be brought into contact with the grinding surface of said grinding wheel by relative movement of said wheel head to said work head.

2. A wheel truing apparatus adapted for use in a cylindrical grinding machine wherein a work table provided with a work head with a work spindle and a tail stock for support of a workpiece, and a wheel head with a grinding wheel for grinding the workpiece, are mounted on a bed for respective relative movement in a Z-axis direction parallel with the rotation axis of the work spindle and in an X-axis direction intersecting the Z-axis direction, and a transfer device is provided above the work spindle, wherein the wheel truing apparatus comprises a rotary drive portion mounted on the tailstock or the work table, and a wheel truing tool supported on the rotary drive portion for rotation therewith, the wheel truing tool being provided at its outer periphery with a truing portion for truing a grinding surface of the grinding wheel brought into contact therewith, wherein the rotary drive portion is placed in a position adjacent to said tailstock in a tooling area in the Z-direction, the tooling area being defined between said work head and said tail stock in the Z-axis direction, and wherein the rotary drive portion is spaced radially downward from said tailstock to avoid interference with the transfer device provided above the tailstock, and wherein the rotary drive portion is arranged such that the rotation axis line of said truing tool is oriented perpendicular to the rotation axis line of said grinding wheel in a condition where said truing portion is placed in contact with the grinding surface of said grinding wheel, whereby the truing portion of said truing tool may be brought into contact with the grinding surface of said grinding wheel by relative movement of said wheel head to said work head.

3. The wheel truing apparatus as claimed in any one of claim 1 or 2, wherein the truing portion of said wheel truing tool comprises a first truing portion in the form of a thin disc extending radially outward from the outer periphery of a disc base driven by said rotary drive portion and a second cylindrical truing portion protruding in an axis line direction.

4. The wheel truing apparatus as claimed in claim 1 or 2, wherein said grinding wheel is supported on said wheel head for rotation about a rotation axis line perpendicular to the X-axis direction, and said rotation axis line of said wheel truing tool extends perpendicular to the rotation axis line of said grinding wheel, wherein an end surface of said grinding wheel crossing perpendicularly to the rotation axis line may be trued by the outer periphery of a truing portion protruded radially outward from said truing tool.

5. The wheel truing apparatus as claimed in any one of claim 1 or 2, further including a rotary support member mounted on said work head or the member united therewith for supporting said rotary drive portion in such a manner that said rotary drive portion may be rotated about a rotation axis line perpendicular to the rotation axis line of said grinding wheel and rotated about a rotation axis line parallel with the rotation axis line of said grinding wheel.

* * * * *